US011274498B2

(12) United States Patent
Moberg et al.

(10) Patent No.: US 11,274,498 B2
(45) Date of Patent: Mar. 15, 2022

(54) DRILL MAST LOCKING SYSTEM

(71) Applicant: Caterpillar Global Mining Equipment LLC, Denison, TX (US)

(72) Inventors: Carl J. Moberg, Dunlap, IL (US); Rex Aaron Glover, Denison, TX (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 0 days.

(21) Appl. No.: 16/991,008

(22) Filed: Aug. 11, 2020

(65) Prior Publication Data

US 2022/0049551 A1 Feb. 17, 2022

(51) Int. Cl.
*E21B 15/00* (2006.01)
*E21B 7/02* (2006.01)

(52) U.S. Cl.
CPC ..... *E21B 7/023* (2013.01); *E21B 15/003* (2013.01)

(58) Field of Classification Search
CPC ..... E21B 7/023; E21B 15/003; E21B 15/00
See application file for complete search history.

(56) References Cited

U.S. PATENT DOCUMENTS

2013/0197737 A1* 8/2013 Malayappalayam Shanmugam ..... E02F 3/30 701/29.1
2015/0197993 A1 7/2015 Lee et al.
2016/0017703 A1* 1/2016 Friend ..... E21B 47/022 340/853.8
2019/0186212 A1* 6/2019 Gonzalez ..... E21B 3/02
2019/0292851 A1 9/2019 Clarke et al.
2019/0368285 A1* 12/2019 Natarajan ..... E21B 7/02

FOREIGN PATENT DOCUMENTS

CN 203729970 U * 7/2014
CN 108708675 A 10/2018
CN 108708674 B * 8/2020

* cited by examiner

*Primary Examiner* — Taras P Bemko
(74) *Attorney, Agent, or Firm* — von Briesen & Roper, s.c.

(57) ABSTRACT

A method includes receiving a user input to conduct a coarse pivot movement of a drill mast. A locking-pin withdraw signal is sent to a locking pin actuator for a first period of time. Responsive to determining that a locking pin is engaged with a locking hole after the first period of time, the drill mast is repositioned from a current angle to an initial angle. A second locking-pin withdraw signal is sent to the locking pin actuator for a second period of time. Responsive to determining that the locking pin is engaged with the locking hole after the second period of time, the drill mast is repositioned between a minimum drill mast angle and a maximum drill mast angle and sending a third locking-pin withdraw signal to the locking pin actuator for a third period of time.

20 Claims, 5 Drawing Sheets

DRILL MAST LOCKING SYSTEM

TECHNICAL FIELD

This disclosure relates to rotary/blast hole drilling machines. More particularly, this disclosure relates to systems and methods to withdraw a locking pin from a locking hole to permit coarse pivot movements of the drill mast.

BACKGROUND

Rotary/blast hole drilling machines are utilized in surface mining operations where the mast drilling machine drills/bores in rocks and other materials in desired locations. The drilling machine commonly includes a drill mast that is stationed on a mainframe of the machine and hydraulically connected thereto. In operation, a lift system moves the drill mast from the transport position (stowed position) to an operation or drilling position. When in a drilling position the vehicle functions as a counterweight or base for the mast to prevent the mast from tipping over, causing significant damage and danger. Once the mast is in the desired drilling position, one or more locking mechanisms can be used to lock the mast in position. One such locking mechanism includes a locking pin being inserted into a locking hole.

The lift system rotates the drill mast about a pivot point from the stowed position to the drilling position. When in the drilling position, the mast is generally perpendicular to the ground (assuming a level ground surface) and perpendicular to the stowed position. As such, the drilling position can also be referred to as a vertical position. Additionally, drilling can be performed with the mast at an angle between the vertical and stowed positions in drilling machines that include a plurality of locking holes spaced apart from each other.

When in the operating position, nominal movement of the drill mast may occur due to tolerance differences between the locking pin and the locking hole. After the drill machine operates, it may be necessary to reposition the drill mast via a coarse pivot movement from the drilling position to either a new drilling position or to the stowed or transport position.

To conduct a coarse pivot movement of the drill mast, the locking pins must first be withdrawn from the locking holes. In some instances, binding may occur between the locking pins and the locking holes such that the locking pin actuators may not be able to withdraw the locking pins from the locking holes. Further, manual operation of drill mast actuators may result in damage to the drill mast due to excessive forces being exerted onto the drill mast with the locking pins still engaged in the locking holes. Manual operation of the drill mast actuators with the locking pins still engaged may even require the operator to override safety interlocks designed to prevent damage from being imparted to the drill mast.

Chinese Patent Application Number 108708675A, titled "Control System and Method for Collapsible Mast with Drill Rod of Rotary Drilling Rig," discloses one such system. In the '675 Patent Application, the a control method for the collapsible mast with the drill rod is provided. The system includes a control valve, a detection device, and a controller. The detection device is used for detecting the states (the weight of a shaft pin of the drill rod and the inclination angle of the mast) of the system. The controller receives the states and controls the control valve to move according to the states. Therefore, the mast can be collapsed. However, there is still room for improvement over such as system.

SUMMARY OF THE INVENTION

In one embodiment, a drilling machine includes a drill mast having a locking hole, the drill mast configured to rotate about a pivot point at a base of the drill mast, a mast position actuator configured to pivot the drill mast to change a drill mast angle, and a locking pin actuator. The locking pin actuator is configured to insert a locking pin into the locking hole to restrict the drill mast into a drilling position and to withdraw the locking pin from the locking hole to permit a coarse pivot movement of the drill mast. The drilling machine further includes a drill mast angle sensor configured to detect the drill mast angle and to transmit, to a controller, the drill mast angle measurements. The controller is configured to: receive the drill mast angle measurements from the drill mast angle sensor, store an initial drill mast angle measurement corresponding to an initial drill mast angle at a time that the locking pin is inserted into the locking hole, and withdraw the locking pin at least in part by: repositioning, via the mast position actuator, the drill mast from a current drill mast angle to the initial drill mast angle. Further, the controller sends, to the locking pin actuator, a locking-pin-withdraw signal to retract the locking pin from the locking hole.

Another embodiment takes the form of a mast locking system. The mast locking system includes a mast position actuator configured to pivot a drill mast to change a drill-mast angle. A locking pin actuator is configured to insert a locking pin into a locking hole to restrict the drill mast into a drilling position and withdraw the locking pin from the locking hole to permit a coarse pivot movement of the drill mast. The mast locking system further includes a locking-pin position sensor configured to detect if the locking pin is withdrawn from the locking hole; a drill mast angle sensor configured to detect the drill mast angle, and to transmit, to a controller, drill mast angle measurements. The controller is configured to: receive the drill mast angle measurements from the drill mast angle sensor; store an initial drill mast angle measurement corresponding to an initial drill mast angle at a time that the locking pin actuator is inserted into the locking hole; and withdraw the locking pin at least in part by: repositioning, via the mast position actuator, the drill mast from a current drill mast angle to the initial drill mast angle; sending, to the locking pin actuator, a locking-pin-withdraw signal to retract the locking pin from the locking hole; and responsive to determining that the locking pin is withdrawn from the locking hole, stopping the mast position actuator and the locking pin actuator.

In yet another example, a method is provided for. In the method, responsive to receiving a user input to conduct a coarse pivot movement of a drill mast, a locking-pin withdraw signal is first sent to a locking pin actuator for a first period of time. Responsive to determining that a locking pin is engaged with a locking hole after the first period of time, the drill mast is repositioned from a current angle to an initial angle and a second locking-pin withdraw signal is sent to the locking pin actuator for a second period of time. The initial angle corresponds to a drill mast angle when the locking pin was inserted into the locking hole. Responsive to determining that the locking pin is engaged with the locking hole after the second period of time, repositioning the drill mast is repositioned between a minimum drill mast angle and a maximum drill mast angle and a third locking-pin withdraw signal is sent to the locking pin actuator for a third period of time.

BRIEF DESCRIPTION OF THE DRAWINGS

The above and other aspects, features and advantages of the present disclosure will become apparent from the following description of embodiments given in conjunction with the accompanying drawings.

DETAILED DESCRIPTION

The present application is directed to systems and methods of withdrawing locking pins from locking holes to permit coarse pivot movements of a drill mast of a rotary/blast drilling machine.

Figure 1:
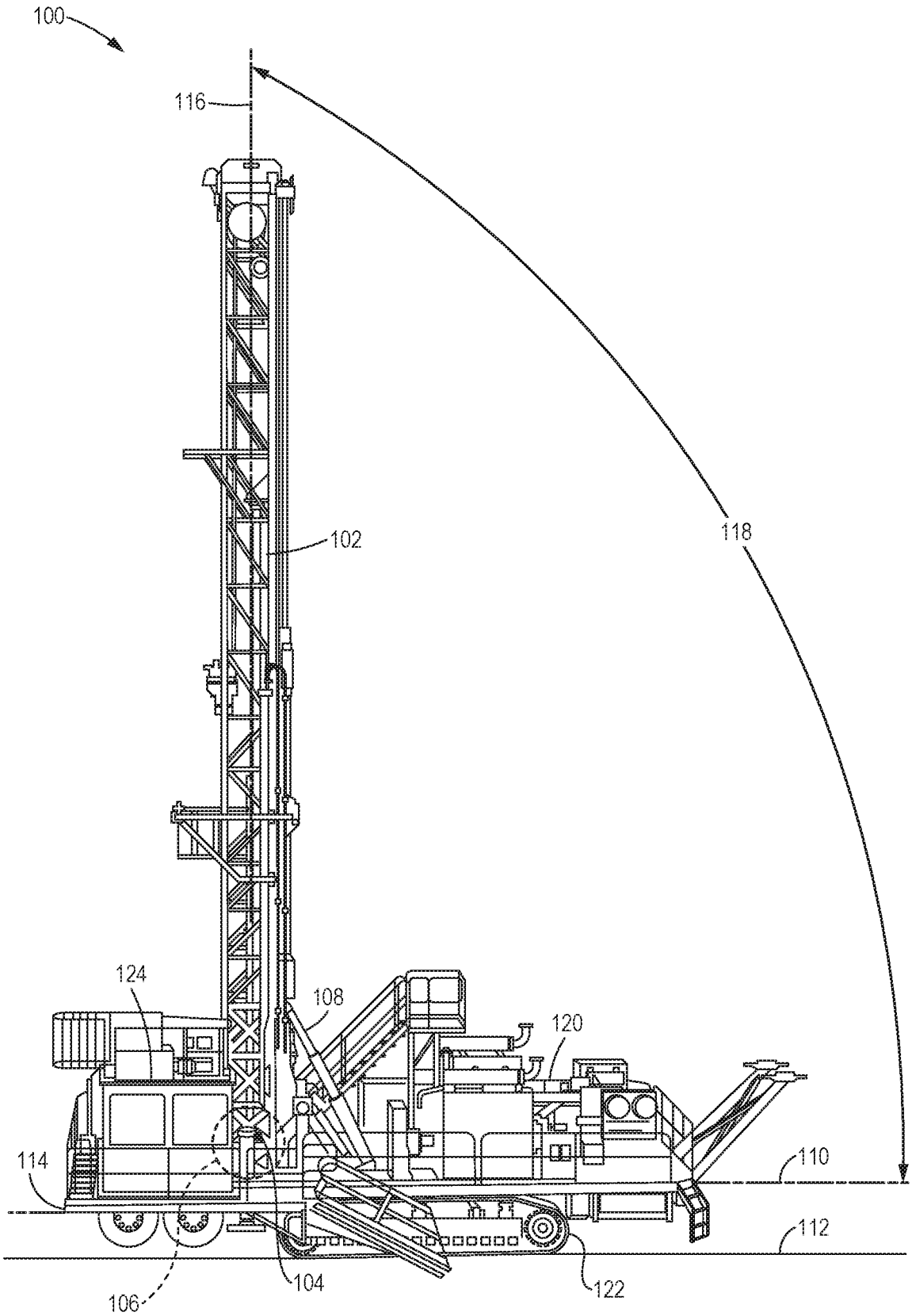
FIG. 1 is a side view of an example drilling machine having a drill mast in a vertical position, in accordance with an embodiment of the present disclosure.

FIG. 1 is a side view of an example drilling machine having a drill mast in a vertical position, in accordance with an embodiment of the present disclosure. In particular, FIG. 1 depicts the drilling machine 100 that includes the drill mast 102 in a vertical position. The drilling machine 100 is situated on the ground surface 112. The frame 114 is supported by the transport mechanism 122. Generally parallel to the ground surface 112 is the frame axis 110. The drill mast 102 extends along the drill mast axis 116. The drill mast angle 118 is the angle between the drill mast axis 116 and the frame axis 110. In FIG. 1, the drill mast 102 has an drill angle of approximately 90 degrees and is roughly perpendicular to the ground surface. The drill mast 102 may be locked in this position and may be in a drilling, or an operational, position.

The drill mast 102 is repositioned by way of the mast position actuator 108. When the mast position actuator 108 retracts, the drill mast 102 pivots about the pivot point 104 located at the base 106 of the drill mast 102. The drill mast 102 may be positioned at another intermediate drill mast angle 118 between the vertical position and the stowed position and subsequently locked into a new drilling or operational position. Alternatively, it may be fully lowered to a stowed, or transport, position, with the drill mast angle 118 being approximately 0 degrees.

The drill mast 102 can be coupled to a frame 114 of the drilling machine 100 that facilitates transport of the drill mast 102. The drill mast 102 can include a support framework that supports an operational implement that can include, for example, a drill. The drill mast 102 can include a mast pivot system configured to pivot the drill mast 102 from the stowed position to the vertical position and vice-versa, and will be discussed in more detail later.

The drilling machine 100 may further include an engine 120 to provide power to move and operate the drilling machine to include providing electrical power to power and control the various services of the drilling machine 100. The drilling machine 100 may further include an operator cab 124 to receive operator input and display indications to the operator.

In some embodiments, the mast position actuator 108 may include both a left-side mast position actuator and a right-side mast position actuator, although only one side is depicted in the side-view of FIG. 1. There may similarly be left-side and right-side components of other aspects of the drilling machine. For example, there may be duplicate locking holes, locking pin actuators, and locking-pin position sensors, discussed later herein.

Figure 2:
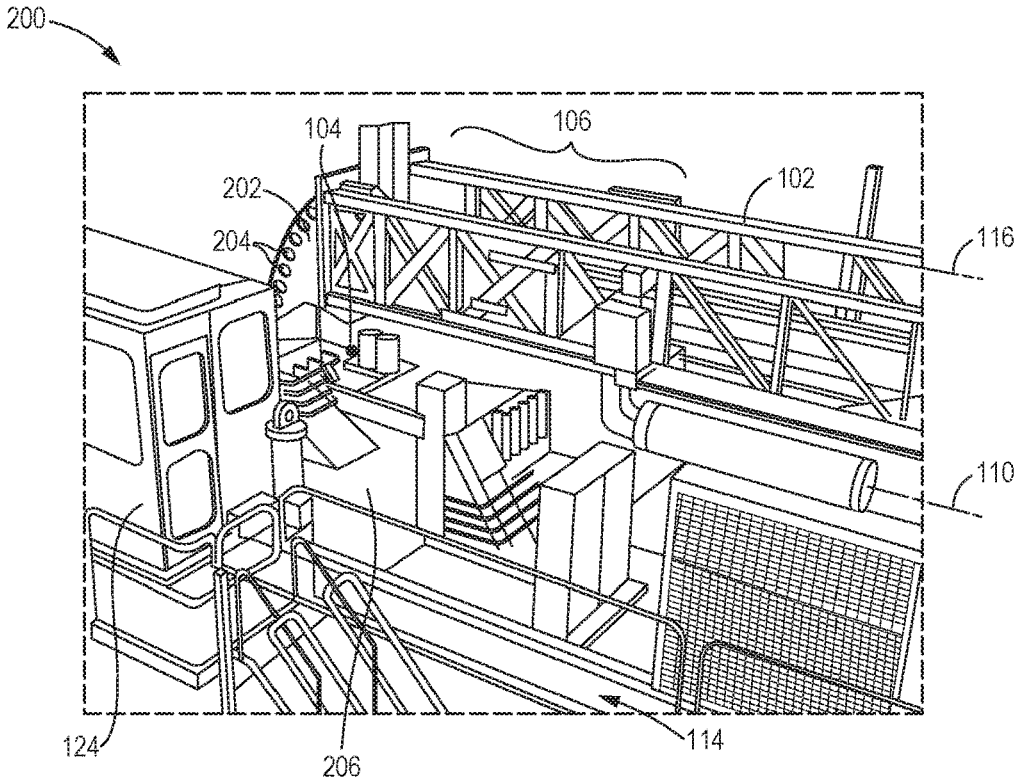
FIG. 2 is a perspective view of a portion of the drilling machine at a base of the drill mast, with the drill mast in a stowed position, in accordance with an embodiment of the present disclosure.

FIG. 2 is a perspective view of a portion of the drilling machine at a base of the drill mast, with the drill mast in a stowed position, in accordance with an embodiment of the present disclosure. In particular, FIG. 2 depicts the perspective view 200 of a portion of the drilling machine 100 located at the base 106 of the drill mast 102. Here, the drill mast 102 is depicted in a stowed position, with its drill mast axis 116 extending approximately parallel to the frame axis 110. At the base 106 of the drill mast 102, a support plate 202 includes at least one, but in some embodiments, a plurality of locking holes 204.

When the drill mast 102 conducts a coarse pivot about its pivot point 104, the support plate 202 may be rotated below a deck surface 206 of the frame 114 to receive locking pins (not depicted in FIG. 2) to restrict the drill mast 102 into a drilling position. Based on the desired drill mast angle 118, one of the respective locking holes 204 may be selected to have the locking pin 304 inserted into. Each locking hole 204 can correlate to a pre-determined drill mast angle 118. Typically, drilling can be performed with the drill mast 102 at the vertical position such that the drill mast 102 is generally perpendicular to the ground surface 112. During operation, circumstances exist in which the drill mast 102 can be orientated at a drill mast angle 118 that is less than 90 degrees relative to the horizontal plane. The particular angle selected can depend, for example, on the type of material or surface that is being drilled.

In some embodiments, the support plate 202 includes both a left-side and a right-side support plate disposed on opposing sides of the drill mast 102. Each of the left-side support plate and the right-side support plate may have complementary locking holes 204, such that a left-side locking pin and a right-side locking pin can be inserted into locking holes 204 located on the respective left-side and right-side support plates 202.

Figure 3:
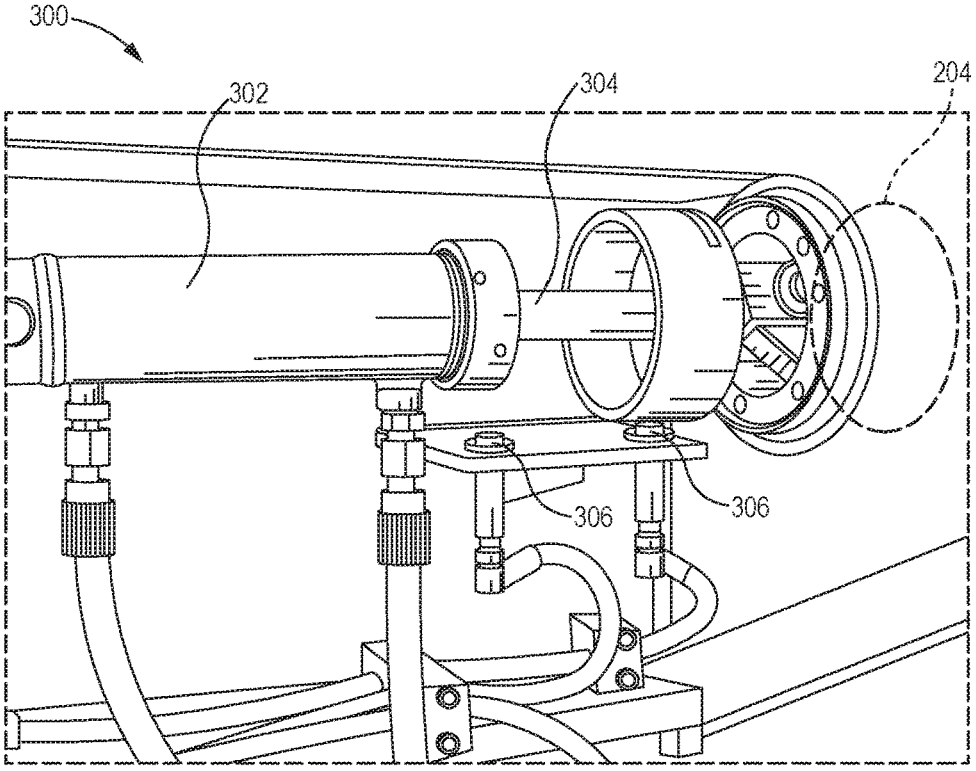
FIG. 3 is a perspective view of a locking pin actuator and a locking pin, in accordance with an embodiment of the present disclosure.

FIG. 3 is a perspective view of a locking pin actuator and a locking pin, in accordance with an embodiment of the present disclosure. In particular, FIG. 3 depicts the view 300 of a locking pin actuator 302 coupled to the locking pin 304. The locking pin actuator 302 may be disposed below the deck surface 206 so as to be aligned with the locking holes 204 when the drill mast 102 is raised. As the locking pin 304 is extended to the rightward direction in FIG. 2, it engages with the locking hole 204 to restrict the drill mast 102 into a drilling position.

Even though the locking pin 304 is engaged with the locking hole 204, some minor, or nominal, movement of the drill mast 102 may occur during drilling operations. This movement may be due to external forces on the drill mast 102 (e.g., wind, drilling counterforces) and tolerance differences between the diameter of the locking pin 304 and the locking hole 204. It is expected that the drill mast angle 118 may nominally vary up to +/−1 degree, +/−2 degrees, or even up to +/−5 degrees in extreme cases based on tolerance differences. When the locking pin 304 is withdrawn from the locking hole 204, the drill mast 102 may be moved through a coarse pivot movement. The coarse pivot movement may then reposition the drill mast 102 to a new drill mast angle 118 or reposition the drill mast 102 to the stowed or transport position.

The locking pin 304 may extend inward toward the drill mast 102 to engage the locking hole 204. In some embodiments, the locking pin 304 can be electro-hydraulically controlled. Fluid hoses can be connected to an electrohydraulic valve that can control fluid supplied to the system for moving the locking pin 304. Similar fluid hoses may be utilized to provide power to the mast position actuator 108. The electrohydraulic valves for the locking pin 304 can be connected to corresponding solenoids for actuation of the locking pin 304.

One or more locking-pin position sensors 306 can be used to detect whether the drill mast 102 is successfully locked (i.e. whether the locking pin 304 is sufficiently engaged with the locking hole 204 to prevent movement of the drill mast 102). In an example, the one or more locking-pin position sensors 306 can include a proximity switch. If the locking pin 304 is not fully engaged with the locking hole 204 on the support plate 202, the locking-pin position sensors 306 can relay to the controller that the drill mast 102 was not successfully locked or pinned. Additionally, or instead of the proximity switch, the locking-pin position sensor 306 may comprise a cylinder position sensor that is configured to detect the position of the cylinder within the locking pin actuator 302.

Similarly, the locking-pin position sensors 306 may also relay to the controller that the locking pin 304 is not disengaged (e.g., is still engaged) with the locking hole 204. With the locking pin 304 being engaged with the locking hole 204, the controller may restrict use of the mast position actuator 108 and/or provide visible indications to the operator at the operator cab 124.

Figure 4:
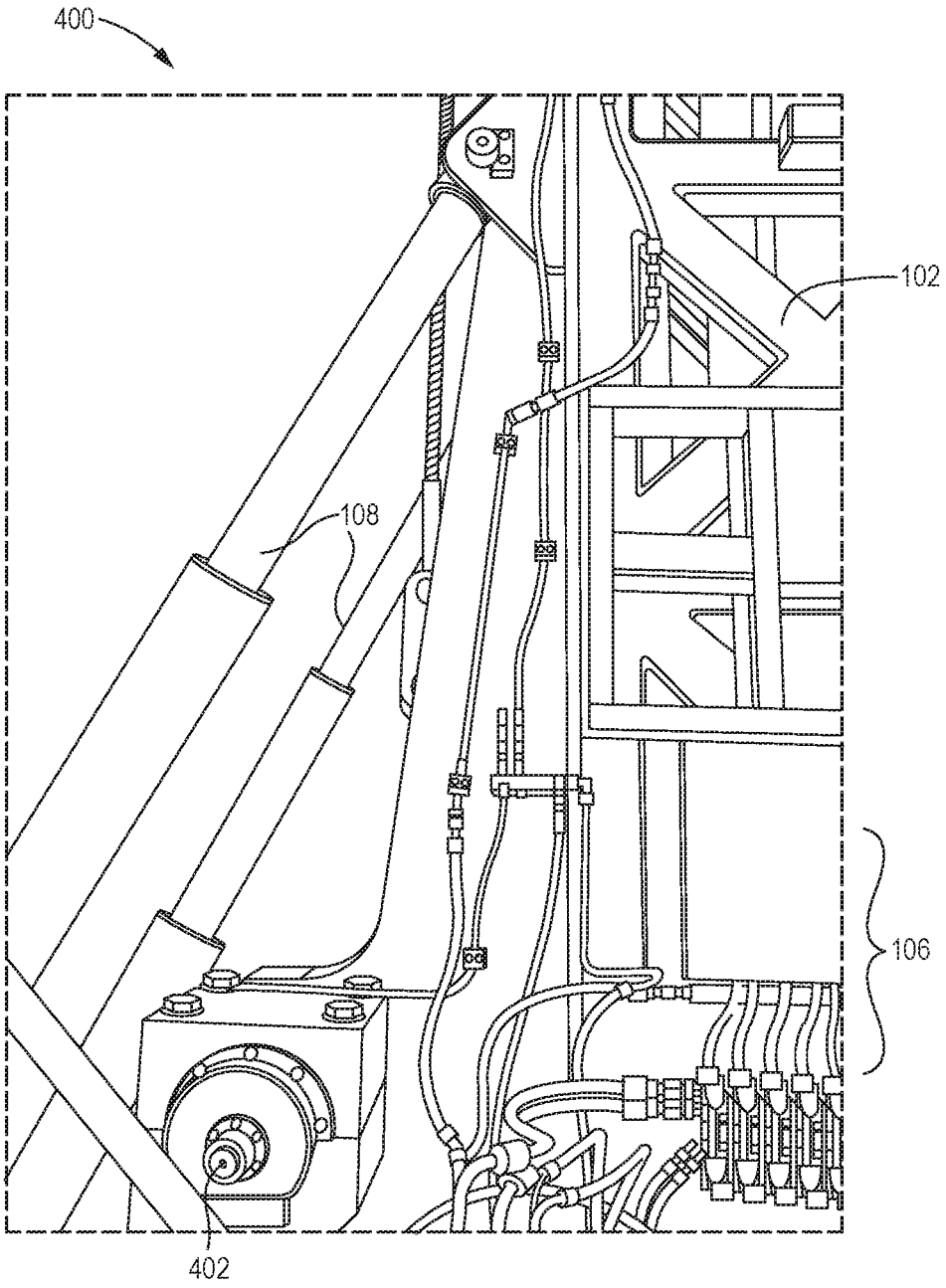
FIG. 4 is a perspective view of a portion of the drilling machine at a base of the drill mast, with the drill mast in an operating position, in accordance with an embodiment of the present disclosure.

FIG. 4 is a perspective view of a portion of the drilling machine at a base of the drill mast, with the drill mast in an operating position, in accordance with an embodiment of the present disclosure. In particular, FIG. 4 depicts the perspective view 400 showing the base 106 of the drill mast 102. Here, the drill mast 102 is in a vertical position. The mast position actuator 108 (depicted as a left-side and a right-side mast position actuator) is extended. The support plate 202 is rotated below the deck surface 206 of the drilling machine 100. As such, the locking pins 304 may be inserted into the locking holes 204 to restrict the drill mast 102 into an operational, or drilling, position.

Also shown in the view 400 is the drill mast angle sensor 402. The drill mast angle sensor 402 measures the drill mast angle 118. The measured mast angle can be relayed to the controller (e.g., controller 502) and displayed such that the machine operator can track the measured mast angle. The measured mast angle can be tracked independent of whether the mast is locked or unlocked. The drill mast angle sensor 402 is selected to be sensitive enough to measure the drill mast angle 118 as it nominally moves when in the drilling position. As such, the drill mast angle sensor 402 may measure to the nearest 0.5 degree, the nearest 0.1 degree, and possibly to the nearest 0.01 degree.

In various embodiments, the drill mast angle sensor 402 measures an initial drill mast angle at a time that the locking pin 304 is inserted into the locking hole 204. This initial angle measurement is provided to a controller and may be stored.

In yet other embodiments, the drill mast angle sensor 402 continually measures the drill mast angle 118 and provides the drill mast angle measurements to the controller. The controller may then determine a maximum drill mast angle 118 and a minimum drill mast angle 118 during the operation of the drilling machine 100 (e.g., while the locking pin 304 is engaged with the locking hole 204.)

In some embodiments, the drill mast angle sensor 402 may be realized at least in part by a position sensor of the mast position actuator instead of a stand-alone component. For example, the mast position actuator 108 may be a position-sensing hydraulic cylinder configured to determine an extension length of the mast position actuator 108. Based on this extension length, a drill mast angle 118 may be calculated (e.g., by the controller 502) based on the extension length mast position actuator 108.

Figure 5:
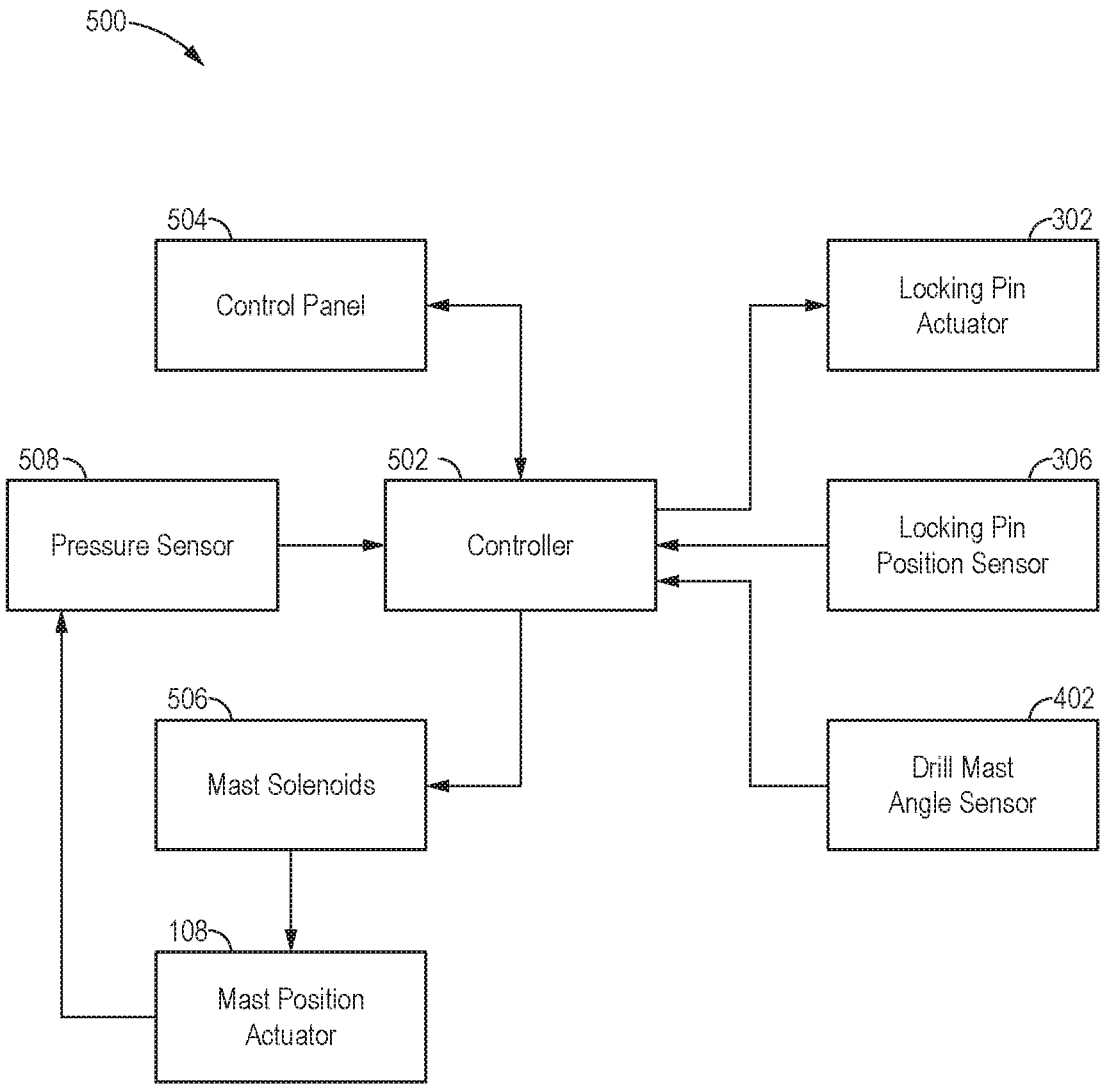
FIG. 5 is a block diagram of a mast locking system, in accordance with an embodiment of the present disclosure.

FIG. 5 is a block diagram of a mast locking system, in accordance with an embodiment of the present disclosure. In particular, FIG. 5 depicts the mast locking system 500 that includes a controller 502, a control panel 504, raise/lower mast solenoids 506, pressure sensors 508, the mast position actuator 108, the locking pin actuator 302, the locking-pin position sensor 306, and the drill mast angle sensor 402.

The controller 502 may be realized by one or more electronic control units. The controller 502 can be an embedded system that controls the drilling machine electrical systems and/or other subsystems of the machine. The controller 502 can be communicatively connected to other components of the drilling machine 100 and configured to send and receive data, sensor, or other analog or digital signals, and other information between various other electronic control units of the machine.

The mast locking system 500 can include an controller 502, which may also be referred to as an electronic control module (ECM), configured for communication with a control panel 504 of the drilling machine 100. In an example, the control panel 504 can be located inside an operator cab 124 of the drilling machine 100. The control panel 504 can receive user inputs, such as a desired mast angle and a request to conduct a coarse pivot movement of the drill mast 102, and communicate such user inputs to the controller 502. The controller 502 can relay outputs to the control panel 504, such as successful lock or failure to lock signals. In an example, such outputs can be displayed on the control panel 504. The control panel 504 may also provide audible alerts to proper, or improper, engagement and withdraw of the locking pins 304, among other indications.

The controller 502 can engage one or more raise/lower mast solenoids 506 to provide an electrohydraulic signal to move the drill mast 102 (via the mast position actuators 108), depending on the starting position of the drill mast 102 and the desired drill mast angle 118.

The pressure sensors 508 are configured to determine an amount of pressure, or force, at the mast position actuator 108 in an axial direction. The pressure sensors 508 may measure a hydraulic pressure within the mast position actuator 108, for example, at the outlet of the mast solenoids 506. Alternatively, they may be a strain gage attached to the mast position actuator 108 that measures the strain on the cylinder of the mast position actuator 108, which may then be converted to an axial force of the mast position actuator 108.

The drill mast angle sensor 402 can be connected to the controller 502 and relay the measured mast angle to the controller 502 as the mast is being moved, either by the mast position actuators 108 or by the normal drilling operations of the drill machine when the locking pins 304 are engaged with the locking holes 204.

The controller 502 can engage one or more locking pin actuators 302 to provide an electrohydraulic signal to move the one or more locking pins 304 for engagement with the locking holes 204 on the support plate 202 of the drill mast 102. The one or more locking-pin position sensors 306 can determine whether the one or more locking pins 304 is sufficiently engaged with the selected locking hole 204 and relay such determination to the controller 502, such that the controller 502 can determine whether the mast is successfully locked or unlocked.

The controller 502 can include software, hardware, and combinations of hardware and software configured to execute a number of functions attributed to the components of the drilling machine 100 described herein. The controller 502 can include an analog, digital, or combination analog and digital controllers having a number of components. As examples, the controller 502 can include integrated circuit boards or (ICBs), printed circuit boards (PCBs), processor(s), data storage devices, switches, relays, etcetera. Examples of processors can include any one or more of a microprocessor, a controller, a digital signal processor (DSP), an application specific integrated circuit (ASIC), a field-programmable gate array (FPGA), or equivalent discrete or integrated logic circuitry.

The controller 502 can include storage media to store and/or retrieve data or other information, for example, signals from sensors, including locking-pin position sensors 306 and drill mast angle sensor 402. Examples of non-volatile storage devices include magnetic hard discs, optical discs, floppy discs, flash memories, or forms of electrically programmable memories (EPROM) or electrically erasable and programmable (EEPROM) memories. Examples of volatile storage devices include random access memories (RAM), dynamic random access memories (DRAM), static random access memories (SRAM), and other forms of volatile storage devices. The data storage devices can be used to store program instructions for execution by processor(s) of the controller 502.

The controller 502 can be configured to communicate with other components of the drilling machine via various wired or wireless communications technologies and components using various public and/or proprietary standards and/or protocols. Examples of transport mediums and protocols for electronic communication between components of the machine include Ethernet, Transmission Control Protocol/Internet Protocol (TCP/IP), 802.11 or Bluetooth, or other standard or proprietary transport mediums and communication protocols.

In an example, the controller 502 can be the main control unit of the drilling machine 100. In an example, the drilling machine operations system can include additional electronic control units, such as, for example, an engine control module, a transmission control module, and an implement control module associated with one or more implements coupled to and operable from the machine. The various components of the machine can be connected to the controller 502 via a wired or wireless connection. The controller 502 can control additional features and components of the machine, in addition to the mast calibration and positioning. Updates to the controller 502 can be installed onto the controller 502, using, for example, hardware flashing. Software changes can be made to the controller 502 to reflect a particular design of the machine or changes made after the machine was assembled. For example, although a design with two locking pins 304 (one on each side of the drill mast 102) is described above, it is recognized that in other examples, the machine can include only one locking pin 304. The software in the controller 502 can be updated to accommodate a single locking pin design.

The controller 502 may be also be configured to receive information from and operate aspects of the mast locking system 500 or the drilling machine 100. In one embodiment, the controller 502 receives drill mast angle measurements from the drill mast angle sensor 402. The controller 502 may store an initial drill mast angle measurement that corresponds to an initial drill mast angle measurement at a time that the locking pin actuator 302 inserts the locking pin 304 into the locking hole 204. The controller 502 may then withdraw the locking pin 304 at least in part by repositioning, via the mast position actuator 108, the drill mast 102 from a current drill mast angle to the stored initial drill mast angle. The controller 502 may also send, to the locking pin actuator 302, a locking-pin-withdraw signal to retract the locking pin 304 from the locking hole 204. The various locking-pin withdraw signals may be a single signal sent to actuate the locking pin actuator 302 for a set time period, or the locking pin actuator 302 may only attempt to actuate for the duration that it is in receipt of an actuation signal, such as the locking-pin withdraw or a locking-pin insertion signal.

In some embodiments, the drill mast 102 is repositioned concurrent with sending the locking-pin-withdraw signal. Thus, the controller 502 causes the locking pin actuator 302 to attempt to withdraw the locking pin 304 from the locking hole 204 at the same time as the mast position actuator 108 is repositioning the drill mast 102. In yet another embodiment, the drill mast 102 is repositioned prior to sending the locking-pin-withdraw signal. In that embodiment, the drill mast 102 is not repositioned at the same time as the locking pin actuator 302 is attempting to withdraw the locking pin 304 from the locking hole 204.

In some embodiments, repositioning the drill mast 102 from the current drill mast angle to the initial drill mast angle may only occur after a first unsuccessful attempt to withdraw the locking pins 304 from the locking holes 204 without first repositioning the drill mast 102. In such an embodiment, the controller 502 may transmit the locking-pin-withdraw signal for a first time period before determining that the locking pin failed to withdraw (e.g., as detected by the locking-pin position sensor 306.)

The controller 502 may also determine a maximum drill mast angle position and a minimum drill mast angle position from the stored drill mast angle measurements. In such an embodiment, the drill mast angle sensor 402 may continually measure the drill mast angle 118 and provide these drill mast angle measurements to the controller 502. The controller 502 may store continually, or periodically, store the mast angle measurements. The controller 502 may further process the mast angle measurements to correct for sensor inaccuracy and drift and determine a maximum drill mast angle position and a minimum drill mast angle position. Further, the controller 502 may alternatively or additionally determine the mast angle positions based on the drill mast angle sensor 402 that comprises the position-sensing cylinder of the mast position actuator 108.

In some embodiments, withdrawing the locking pin 304 from the locking hole 204 comprises repositioning the drill mast 102 between the determined maximum drill mast angle position and the minimum drill mast angle position. During this repositioning, the controller 502 may limit the mast position actuator 108 to only exert forces on the drill mast 102 that would vary the position of the drill mast 102 between its maximum and minimum observed drill mast angles 118 during the course of the operation of the drilling machine 100. Limiting operation of the mast position actuator 108 between these values may prevent damage to the drill mast 102 by way of excess force being exerted on the drill mast in an attempt to move the drill mast 102 beyond the maximum positions observed. The repositioning may further be limited to move the drill mast 102 within a reduced operating band that is within the band between the maximum and minimum observed drill mast angles.

The initial drill mast angle may alternatively be a calculated drill mast angle that is between the maximum and minimum drill mast angles. In such embodiments, the initial drill mast angle that corresponds to the drill mast angle at the time the locking pin 304 is inserted into the locking hole 204 may be inaccurate or deleted, for example due to sensor error or controller faults. In such embodiments, the initial drill mast angle may be calculated as being a value between the observed maximum and minimum drill mast angle measurements. The value may be an average value between the maximum and minimum drill mast angle measurements, a time-weighted average, a mean value, a median value, or the like. Thus, when repositioning the drill mast 102 to the initial drill mast angle, the controller repositions the drill mast 102 to the calculated initial drill mast position.

In some embodiments, a locking-pin position sensor 306 is provided in the mast locking system 500. The controller 502 may further be configured to stop sending the locking-pin withdraw signal after a first time delay if the locking pin 304 is not withdrawn from the locking hole 204, as detected by the locking-pin position sensor 306. The locking-pin withdraw signal may stop being sent after determining, by the locking-pin position sensor 306, that the locking pin 304 has successfully been withdrawn from the locking hole 204.

In some embodiments, the mast position actuator 108 comprises a left-side mast position actuator and a right-side mast position actuator disposed on an opposite side of the drill mast 102 from the left mast position actuator. The locking pin actuator 302 comprises a left-side locking pin actuator and a right-side locking pin actuator disposed on the opposite side of the drill mast from the left locking pin actuator. In such an embodiment, withdrawing the locking pin 304 comprises determining that one of a left-side locking pin and a right-side locking pin is not withdrawn. The controller 502 then sends, to a respective locking pin actuator 302, the locking-pin-withdraw signal to retract a respective one of the left locking pin and the right locking pin that is not withdrawn. In another such embodiment, the controller 502 may send a reposition signal to just one of the left-side mast position actuator 108 or the right-side mast position actuator 108 associated with the locking pin 304 that has not yet disengaged from the locking hole 204.

The various locking-pin withdraw methods disclosed herein may occur responsive to receiving a user input (e.g., at the control panel 504) to conduct a coarse pivot movement of the drill mast, or after receiving a user request to unlock the drill mast 102. The various methods described herein may be performed in varying order. Thus, in some embodiments, withdrawing the locking pin may comprise first sending a locking-pin withdraw signal to the locking pin actuator 302 without repositioning the drill mast 102, then repositioning the drill mast 102 from the current drill mast angle to the initial drill mast angle while sending the locking-pin withdraw signal to the locking pin actuator 302, and then repositioning the drill mast 102 from between the maximum and minimum drill mast angles while sending the locking-pin withdraw signal to the locking pin actuator 302. In other embodiments, the order of these attempts may be rearranged, or various steps omitted.

In some embodiments, the controller 502 operates in an automatic mode. In such embodiments, the controller 502 receives a request to conduct a coarse pivot movement of the drill mast 102 or to unlock the drill mast 102. The controller 502 then controls the locking pin actuator 302 and the mast position actuator 108 to withdraw the locking pin 304 from the locking hole 204. Normally, the controller 502 may not permit operation of the mast position actuator 108 when the locking pin 304 is engaged with the locking hole 204 due to safety interlocks that prevent damage being inflicted by the mast position actuator 108 exerting forces on the drill mast 102 when the locking pin 304 is engaged with the locking hole 204. However, in automatic mode, the controller 502 controls operation of the mast position actuator 108. This ensures that the drill mast is positioned either back to its initial mast angle measurement, or between the observed maximum and minimum mast angle measurements during operation when the locking pin 304 was engaged with the locking hole 204.

In some embodiments, the controller 502 is further configured to determine if the mast position actuator 108 has stalled in its movement. While attempting to withdraw the locking pin 304, the controller 502 may reposition the mast position actuator 108. The controller 502 may determine that the mast position actuator 108 has stalled by failing to observe a corresponding movement of the drill mast 102 during the repositioning of the mast position actuator 108, or by observing a force that exceeds an axial threshold force along the mast position actuator 108.

When the mast position actuator 108 is being repositioned (e.g., by way of the mast solenoids 506 being actuated by the controller 502) it is expected that the mast position actuator 108 will change length—either extend or retract—and the drill mast angle 118 will change. In a condition that the mast position actuator 108 has stalled, the mast solenoids 506 may be actuated, but the controller 502 may not observe the expected change in length of the mast position actuator 108 (e.g., as observed by a position-sensing cylinder) or the change in the drill mast angle 118 (e.g., as observed by the drill mast angle sensor 402). Further, the stall determination may comprise the pressure sensor 508 detecting a pressure force that exceeds the threshold force.

Responsive to determining that the mast position actuator 108 has stalled, the controller 502 may stop repositioning of the mast position actuator 108. Stopping the repositioning may avoid imparting excess forces on the drill mast 102. The controller 502 may then be configured to attempt to withdraw the locking pin 304 after stopping the mast position actuators 108 from repositioning.

INDUSTRIAL APPLICABILITY

Example machines in accordance with the present application can be used in a variety of applications for surface mining or hard rock mining. As a drilling machine begins operation, the mast locking system can be used to withdraw the locking pin from the locking hole in the event that the locking pin becomes bound to the locking hole during operation. The measured mast angle, either at the initial time when the locking pin is inserted into the locking hole, or the maximum and minimum angles observed during operation, may be utilized to permit the mast position actuators to reposition the drill mast to effectively withdraw the locking pin from the locking hole. The controller executing these functions, based on sensor input from the drill mast angle sensor and the locking-pin position sensor, prevents damage that may occur by an operator overriding safety interlocks to reposition the drill mast via the mast position actuator 108 in manual control when the locking pins are engaged with the locking holes.

Figure 6:
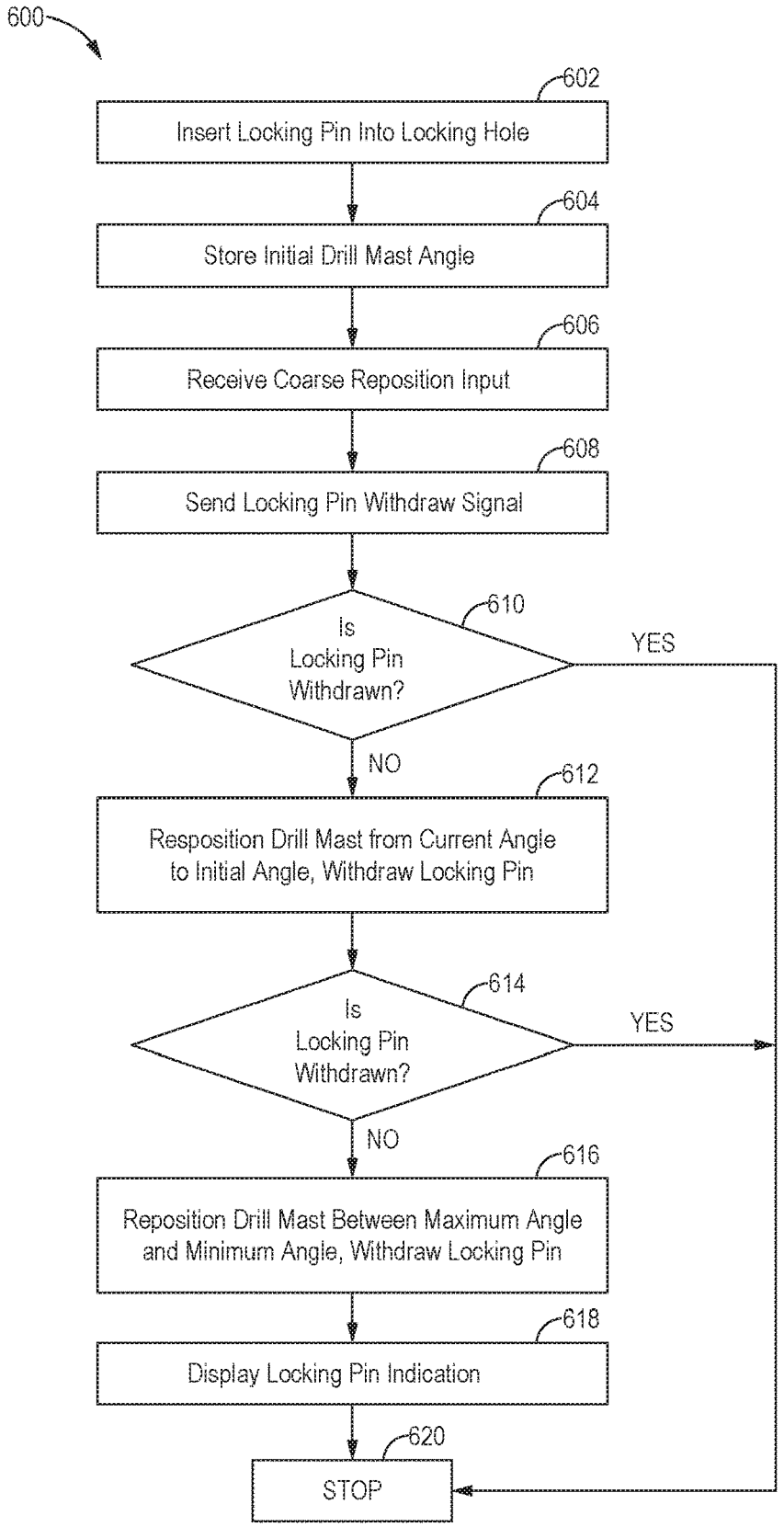
FIG. 6 is a flowchart of an example method, in accordance with an embodiment of the present disclosure.

FIG. 6 is a flowchart of an example method, in accordance with an embodiment of the present disclosure. In particular, FIG. 6 depicts the method 600 that may be used in combination with either the drilling machine 100, the mast locking system 500, or other similar systems. By way of example, aspects of the drilling machine 100 and the mast locking system 500 are used to describe the method 600 below as one non-limiting example.

At block 602, a locking pin 304 is inserted into a locking hole 204. In general, inserting the locking pin 304 into the locking hole 204 restricts the drill mast 102 into a drilling position, only permitting nominal movement of the drill mast 102. The locking pin 304 may be inserted into any one of a plurality of locking holes 204 based on the desired drill mast angle 118. Additionally, the drilling machine 100 may be equipped with a plurality of locking pins 304 and a plurality of locking holes 204, such as left-sided and right-sided components. As such, at block 602, both the left-side and right-side components are engaged. A locking-pin position sensor 306 may detect that the locking pin 304 is fully inserted into the locking hole 204 and provide this indication to the controller 502, which in turn causes a 'lock engaged' indication to be presented via the control panel 504.

At block 604, an initial drill mast angle 118 is stored. The initial drill mast angle measurement corresponds to an initial drill mast angle at a time that the locking pin 304 is inserted into the locking hole 204. This initial drill mast angle measurement thus corresponds to a relative position between the drill mast 102 and the frame 114 that freely permitted the locking pin 304 to be inserted into the locking hole 204 without obstruction or binding. In some other embodiments, the initial drill mast angle may be a calculated initial drill mast angle that is between a maximum and a minimum drill mast angle over a period of time.

At block 606, a user input may be received to conduct a coarse pivot movement of the drill mast 102 or to unlock the drill mast 102. The coarse pivot movement may be conducted to change the operational drilling angle and having the locking pin 304 be inserted into another one of the locking holes 204 or to move the drill mast 102 into a stowed position. However, before full and unrestricted operation of the mast position actuator 108, the locking pin 304 is to be removed from the locking hole 204 to prevent damage from occurring to the drill mast 102.

At block 608, the controller 502 sends, to the locking pin actuator 302 a withdraw signal to retract, or withdraw, the locking pin 304 from the locking hole 204. The locking pin actuator 302 is then actuated to attempt to withdraw the locking pin 304 from the locking hole 204.

At block 610, it is determined if the locking pin 304 has been withdrawn from the locking hole 204. This determination may be accomplished, in part, by the locking-pin position sensor 306 detecting that the locking pin 304 is fully withdrawn from the locking hole 204. The locking pin withdraw signal may be sent for a first period of time before checking at block 610. In embodiments with a plurality of locking pins 304, this check at block 610 may require that all locking pins in the plurality of locking pins 304 are withdrawn to satisfy this criteria.

At block 612, if the locking pin 304 has not been withdrawn from the locking hole 204, perhaps after a first attempt or a first period of time has elapsed, the controller 502 may cause the drill mast 102 to be repositioned from a current drill mast angle to the initial drill mast angle that is stored or calculated. Further, at block 612, the a subsequent signal may be sent to the locking pin actuator 302 to withdraw the locking pin 304 from the locking hole 204.

The controller 502 may receive continual drill mast angle measurements from the drill mast angle sensor 402. The most current drill mast angle measurement received at the time of the check at block 610 may be utilized as the most current drill mast position. In one example, if the initial drill mast angle 118 at the time the locking pin 304 was inserted into the locking hole 204 was 85.1 degrees and the current drill mast angle 118 at the time of the check at block 610 determined that the locking pin was not withdrawn was 84.9 degrees, the controller 502 would cause the drill mast 102 to be repositioned from 84.9 degrees to 85.1 degrees. This may be accomplished by the controller sending, to the mast position actuator 108, a control signal to extend or retract to achieve the initial drill mast angle of 85.1 degrees from the current drill mast angle of 84.9 degrees.

In some embodiments, the drill mast 102 is repositioned to the initial drill mast angle prior to sending the locking-pin-withdraw signal. In such an embodiment, the controller 502 may wait to receive an updated drill mast angle measurement from the drill mast angle sensor 402 that the updated drill mast angle measurement matches the initial drill mast angle.

In other embodiments, the drill mast 102 is repositioned at the same time, or concurrent with, the controller 502 sending the locking-pin-withdraw signal. Thus, the locking pin actuator 302 applies the withdraw force to the locking pin 304 as the drill mast 102 is being repositioned from the current drill mast angle to the initial drill mast angle.

At block 614, it is again determined if the locking pin 304 has been withdrawn from the locking hole 204. This check at block 614 may be accomplished in the same manner as the check at block 610. Further, this check may occur after a second period of time has elapsed.

At block 616, if the locking pin is not withdrawn at block 614, the drill mast 102 is repositioned between a maximum angle and a minimum angle, and a locking-pin withdraw signal is sent to retract the locking pin 304 from the locking hole 204. The drill mast angle sensor 402 may continually store mast angle measurements during a drilling operation. The controller 502 may determine a maximum drill mast angle measurement and a minimum drill mast angle measurement since the locking pin 304 has been inserted into the locking hole 204. In other embodiments, the maximum and minimum drill mast angle measurements may be bound by a shorter period of time, such as since power was last restored to the drilling machine 100, over the previous set time period, or the like. The controller 502 may also correct for sensor noise and drift from the drill mast angle sensor 402 to determine the maximum and minimum drill mast angles.

In some embodiments, block 616 of the method 600 may be modified to reposition the drill mast 102 based on a measurement of the pressure sensor 508 or a determination that the mast position actuator 108 has stalled. For example, instead of repositioning the drill mast 102 to the maximum or minimum drill mast angle 118, the controller 502 may reposition the drill mast 102 until the controller 502 determines that the mast position actuator 108 has stalled or that an axial force measured by the pressure sensor 508 exceeds a threshold force.

In other embodiments, block 616 of the method 600 may be modified to reposition the drill mast 102 until any one of three different criteria are satisfied. In such an embodiment, the controller 502 may continually monitor for the three different criteria. For example, the drill mast 102 may be repositioned until the controller 502 detects one of (i) the drill mast angle 118 reaches a maximum or minimum drill mast angle, (ii) the controller 502 determines that the mast position actuator 108 has stalled, or (iii) the axial force of the mast position actuator 108 exceeds a threshold force. After any one of these three criteria are satisfied, the controller 502 may stop repositioning of the drill mast and attempt to withdraw the locking pin 304 from the locking hole 204.

Then, the controller 502 may reposition the drill mast 102 alternatively between the maximum drill mast angle and the minimum drill mast angle while sending the locking-pin-withdraw signal to the locking pin actuator 302. The repositioning of the drill mast 102 may occur in a variety of methods. For example, the controller 502 may send a series of short reposition signals to the mast position actuator 108 to incrementally reposition the drill mast 102 towards either one of the maximum or minimum drill mast angles, or it may continuously transition the drill mast 102 until it reaches the maximum and minimum drill mast angles. The controller may further select to reposition the drill mast 102 in a direction towards the maximum drill angle or the minimum drill angle. Such a selection may coincide with which direction has a greater range of motion until the maximum or minimum angle.

In other embodiments, the controller 502 determines a reduced operating drill mast operating band and repositions the drill mast 102 within the reduced operating band. For example, if the total angular distance between the maximum and minimum drill mast angle is 2.0 degrees, the controller 502 may determine a reduced operating band with a total angular distance of 1.0 degrees. This reduced operating band may be centered between the difference between the maximum and minimum drill mast angles, or it may be centered on the current drill mast angle. The controller 502 then repositions the drill mast 102 within the reduced operating band while sending the locking-pin-withdraw signal to the locking pin actuator 302. If the locking pin 304 still fails to withdraw from the locking hole 204, the controller 502 may then determine an intermediate operating band that is larger than the reduced operating band, but still bounded by the maximum and minimum drill mast angles. It may then attempt to withdraw the locking pin 304 from the locking hole 204 while repositioning the drill mast 102 within the intermediate operating band.

At block 618, a display is provided indicating whether or not the locking pin 304 has been withdrawn from the locking hole 204. At block 620, the process is stopped. This may be accompanied by an error message being provided at the control panel 504.

The above detailed description is intended to be illustrative, and not restrictive. The scope of the disclosure should, therefore, be determined with references to the appended claims, along with the full scope of equivalents to which such claims are entitled.

What is claimed is:

1. A drilling machine comprising:

a drill mast having a locking hole, the drill mast configured to rotate about a pivot point at a base of the drill mast;

a mast position actuator configured to pivot the drill mast to change a drill mast angle;

a locking pin actuator configured to:

insert a locking pin into the locking hole to restrict the drill mast into a drilling position; and withdraw the locking pin from the locking hole to permit a coarse pivot movement of the drill mast;

a drill mast angle sensor configured to detect the drill mast angle and to transmit, to a controller, drill mast angle measurements; and the controller configured to:

receive the drill mast angle measurements from the drill mast angle sensor;

store an initial drill mast angle measurement corresponding to an initial drill mast angle at a time that the locking pin is inserted into the locking hole; and withdraw the locking pin at least in part by:

repositioning, via the mast position actuator, the drill mast from a current drill mast angle to the initial drill mast angle; and sending, to the locking pin actuator, a locking-pin-withdraw signal to retract the locking pin from the locking hole.

2. The drilling machine of claim 1, wherein the drill mast is repositioned concurrent with sending the locking-pin-withdraw signal.

3. The drilling machine of claim 1, wherein the drill mast is repositioned prior to sending the locking-pin-withdraw signal.

4. The drilling machine of claim 1, wherein the controller is further configured to:

continually store drill mast angle measurements during a drilling operation; and determine a maximum drill mast angle position and a minimum drill mast angle position from the stored drill mast angle measurements; wherein withdrawing the locking pin further comprises repositioning the drill mast between the maximum drill angle position and the minimum drill angle position.

5. The drilling machine of claim 1, further comprising a locking-pin position sensor (306), wherein the controller is further configured to stop sending the locking-pin-withdraw signal after a first time delay if the locking pin is not withdrawn from the locking hole based on the locking-pin position sensor.

6. The drilling machine of claim 1, further comprising a locking-pin position sensor, wherein the controller is further configured to determine if the locking pin is not withdrawn from the locking hole based on the locking-pin position sensor; wherein withdrawing the locking pin comprises:

first sending a locking-pin withdraw signal to the locking pin actuator for a first period of time;

if the locking pin is not withdrawn from the locking hole after the first period of time, repositioning the drill mast from the current drill mast angle to the initial drill mast angle and sending the locking-pin withdraw signal to the locking pin actuator for a second period of time.

7. The drilling machine of claim 6, wherein the controller is further configured to:

continually store mast angle measurements during a drilling operation; and determine a maximum drill mast angle position and a minimum drill mast angle position from the stored drill mast angle measurements; wherein if the locking pin is not withdrawn from the locking hole after the second period of time, withdrawing the locking pin further comprises repositioning the drill mast between the maximum drill mast angle position and the minimum drill mast angle position and sending the locking-pin withdraw signal to the locking pin actuator for a third period of time.

8. The drilling machine of claim 1, wherein:

the mast position actuator comprises a left mast position actuator and a right mast position actuator disposed on an opposite side of the drill mast from the left mast position actuator;

the locking pin actuator comprises a left locking pin actuator and a right locking pin actuator disposed on the opposite side of the drill mast from the left locking pin actuator; and withdrawing the locking pin comprises determining that one of a left locking pin and a right locking pin is not withdrawn and sending, to a respective locking pin actuator, the locking-pin-withdraw signal to retract a respective one of the left locking pin and the right locking pin.

9. A mast locking system, the system comprising:

a mast position actuator configured to pivot a drill mast to change a drill mast angle;

a locking pin actuator configured to:

insert a locking pin into a locking hole to restrict the drill mast into a drilling position; and withdraw the locking pin from the locking hole to permit a coarse pivot movement of the drill mast;

a locking-pin position sensor configured to detect if the locking pin is withdrawn from the locking hole;

a drill mast angle sensor configured to detect the drill mast angle and to transmit, to a controller, drill mast angle measurements; and the controller configured to:

receive the drill mast angle measurements from the drill mast angle sensor;

store an initial drill mast angle measurement corresponding to an initial drill mast angle at a time that the locking pin is inserted into the locking hole; and withdraw the locking pin at least in part by:

repositioning, via the mast position actuator, the drill mast from a current drill mast angle to the initial drill mast angle;

sending, to the locking pin actuator, a locking-pin-withdraw signal to retract the locking pin from the locking hole; and responsive to determining that the locking pin is withdrawn from the locking hole, stopping the mast position actuator and the locking pin actuator.

10. The mast locking system of claim 9, wherein the drill mast is repositioned concurrent with sending the locking-pin-withdraw signal.

11. The mast locking system of claim 9, further comprising a pressure sensor configured to determine an axial force of the mast position actuator, wherein the controller is configured to stop repositioning the mast position actuator responsive to the axial force exceeding a threshold axial force.

12. The mast locking system of claim 9, wherein the controller is further configured to:

continually store mast angle measurements during a drilling operation; and determine a maximum drill angle position and a minimum drill angle position from the stored mast angle measurements; wherein withdrawing the locking pin further comprises repositioning the drill mast between the maximum drill angle position and the minimum drill angle position.

13. The mast locking system of claim 9, wherein the controller is further configured to stop sending the locking-pin-withdraw signal after a first time delay if the locking pin is not withdrawn from the locking hole based on the locking-pin position sensor.

14. The mast locking system of claim 9, wherein the controller is further configured to determine if the locking pin is not withdrawn from the locking hole based on the locking-pin position sensor; wherein withdrawing the locking pin comprises:

first sending a locking-pin withdraw signal to the locking pin actuator for a first period of time; and if the locking pin is not withdrawn from the locking hole after the first period of time, repositioning the drill mast from the current drill mast angle to the initial drill mast angle and sending the locking-pin withdraw signal to the locking pin actuator for a second period of time.

15. The mast locking system of claim 14, wherein the controller is further configured to:

continually store mast angle measurements during a drilling operation; and determine a maximum drill angle position and a minimum drill angle position from the stored mast angle measurements; wherein if the locking pin is not withdrawn from the locking hole after the second period of time, withdrawing the locking pin further comprises repositioning the drill mast between the maximum drill angle position and the minimum drill angle position and sending the locking-pin withdraw signal to the locking pin actuator for a third period of time.

16. The mast locking system of claim 9, wherein the controller is further configured to operate in an automatic mode comprising:

responsive to receiving a user input to conduct the coarse pivot movement of the drill mast, first sending a locking-pin withdraw signal to the locking pin actuator for a first period of time;

if the locking pin is not withdrawn from the locking hole after the first period of time, repositioning the drill mast from the current drill mast angle to the initial drill mast angle and sending the locking-pin withdraw signal to the locking pin actuator for a second period of time.

17. The mast locking system of claim 16, wherein the controller is further configured to continually store mast angle measurements during a drilling operation and determine a maximum drill angle position and a minimum drill angle position from the stored mast angle measurements; wherein operating in the automatic mode further comprises repositioning the drill mast between the maximum drill angle position and the minimum drill angle position and sending the locking-pin withdraw signal to the locking pin actuator for a third period of time if the locking pin is not withdrawn after the second period of time.

18. A method comprising:

responsive to receiving a user input to conduct a coarse pivot movement of a drill mast, first sending a locking-pin withdraw signal to a locking pin actuator for a first period of time;

responsive to determining that a locking pin is engaged with a locking hole after the first period of time, repositioning the drill mast from a current angle to an initial angle and sending a second locking-pin withdraw signal to the locking pin actuator for a second period of time, the initial angle corresponding to a drill mast angle when the locking pin was inserted into the locking hole; and responsive to determining that the locking pin is engaged with the locking hole after the second period of time (614), repositioning (616) the drill mast between a minimum drill mast angle and a maximum drill mast angle and sending a third locking-pin withdraw signal to the locking pin actuator for a third period of time.

19. The method of claim 18, wherein:

the locking pin comprises a left locking pin and a right locking pin; and determining that the locking pin is engaged comprises determining that either one of the left locking pin or the right locking pin is engaged.

20. The method of claim 18, further comprising displaying, on a control panel, an indication that the locking pin is withdrawn responsive to determining that the locking pin is not engaged with the locking hole.

* * * * *